US005195355A

United States Patent [19]

Heitze et al.

[11] Patent Number: 5,195,355

[45] Date of Patent: Mar. 23, 1993

[54] APPARATUS FOR CONNECTING A PRESSING DIE TO A SUPPORT IN AN UPSETTING PRESS

[75] Inventors: Gerhard Heitze, Netphen; Horst Grafe, Hilchenbach, both of Fed. Rep. of Germany

[73] Assignee: SMS Schloemann-Siemag Aktiengesellschaft, Dusseldorf, Fed. Rep. of Germany

[21] Appl. No.: 749,585

[22] Filed: Aug. 26, 1991

[30] Foreign Application Priority Data

Aug. 24, 1990 [DE] Fed. Rep. of Germany ..... 4026827

[51] Int. Cl.[5] ..... B21D 37/14

[52] U.S. Cl. ..... 72/481; 72/462

[58] Field of Search ..... 72/206, 347, 407, 462, 72/481

[56] References Cited

U.S. PATENT DOCUMENTS 4,578,983 4/1986 Kimura ..... 72/407
4,790,174 12/1988 Wendland ..... 72/481

FOREIGN PATENT DOCUMENTS 1627421 11/1970 Fed. Rep. of Germany .
2531551 1/1976 Fed. Rep. of Germany .
3902918 4/1990 Fed. Rep. of Germany ..... 72/481
0147432 11/1980 Japan ..... 72/462
0074710 4/1986 Japan ..... 72/206
0135435 6/1986 Japan ..... 72/481
0182327 7/1990 Japan ..... 72/481

*Primary Examiner*—David B. Jones
*Attorney, Agent, or Firm*—Anderson, Kill, Olick & Oshinsky

[57] ABSTRACT

An upsetting press for width reduction of rolled stock, in particular slab width reduction in hot-rolled wide strip mills, includes supports (2) for pressing dies (1) located along opposite slab edges. The pressing dies (1) are detachably connected to the supports (2) by at least one elongated prestressable tie rod (3) rotatably mounted in each support (2). The tie rod (3) has a hammer shaped tie rod head (5) which engages in a recess (6) in the pressing die (1). The recess (6) is open on one surface for receiving the tie rod (3) so that the head abuts against and holds the pressing die against the support (2).

17 Claims, 2 Drawing Sheets

APPARATUS FOR CONNECTING A PRESSING DIE TO A SUPPORT IN AN UPSETTING PRESS

SUMMARY OF THE INVENTION

The present invention is directed to an apparatus for detachably connecting pressing tools or dies to a support in an upsetting press for width reduction of rolled stock, particularly a slab width reduction in hot-rolled wide band strip mills with the upsetting press having supports for the pressing dies facing toward one another along opposite edges of the slab.

A pressure of the type mentioned above for slab width reduction in a slab casting installation is disclosed in DE-OS 25 31 551. The pressing die for slab reduction is mounted on a support. The pressing die and support are moved by a forked connector bar driven by a shaft with a worm gear. Such an arrangement is present for each unit. The worm gears mesh with worm wheels wedged onto eccentric shafts. The pressing die is directed against the slab edges by rotation of the eccentric shafts. The pressing die and the support are connected together by a dovetail-shaped groove into which a clamping strip for mechanical clamping of the parts can be inserted. Such a connection of the pressing die and the support does not permit a rapid automatic replacement of the pressing dies. Furthermore, it should be noted that the pressing dies in upsetting presses can weigh several tons and that die replacement requires manual operations even if a crane is used and can expose maintenance personnel to considerable danger, since the manual operations take place in a very confined interior space of the upsetting press.

In another reshaping apparatus disclosed in De-OS 1 627 421 serving as a hammer as well as a press for reshaping stock, the pressing die is connected to the support, the so-called tup or ram and countertup or ram, with the help of a dovetail-shaped groove. The replacement of a worn die by a new die is also difficult in such an apparatus.

SUMMARY OF THE INVENTION

It is the primary object of the present invention to provide an improved connection between the pressing die or tool and the support for such die in an upsetting press of the type mentioned above. The die can be removed from the support by automatically operated connection elements located in the support and the die can also be clamped in the same manner on the support. Manual handling of heavy tools by operating and maintenance personnel is eliminated in the dangerous regions of the press.

In accordance with the present invention, the connecting apparatus for securing a pressing die to a support in an upsetting press of the type mentioned above is characterized by at least one prestressable tie rod with a hammer shaped tie rod head rotatably mounted on the support for engagement in a recess in the pressing die with the recess open on one side and shaped for receiving the tie rod head so that the head abuts the support. This arrangement affords the connection and disconnection of the pressing die in the upsetting press in a simple manner. Contrary to the conditions in the replacement of dies or tools in known upsetting press arrangements, it is unnecessary to move the entire unit made up of the die or tool and the support out of the press and possibly out of the moving system.

In a preferred arrangement of the present invention, recesses in the pressing die are arranged in a backup flange extending along both long sides of the die facing the support. As a result, the contact surface of the die at the support is increased and several tie rods can clamp the die on both long sides, so that a tilt-free connection with the support can be established.

Another feature of the present invention involves at least one additional recess in at least one backup flange of the pressing die into which a relief or spotting bolt attached to the support can be fitted. This feature facilitates the replacement of the pressing die, since the tie rod head can be fitted very precisely into its assigned recess and can be placed in bearing contact with the abutment surface of the flange.

Another improvement with respect to exchanging the pressing die involves the arrangement of spray nozzles through which a cleaning agent under pressure can be directed in the region of the connection of the tie rod head to the abutment surface of the pressing die. Such spray nozzles provide the removal of scale or other dirt particles deposited on the tie rod head and in its associated recess, whereby the tie rod head can be easily loosened and turned in the recess.

In accordance with the present invention, for satisfactory guidance, the tie rods are supported in guide bores in the support. This arrangement protects the tie rods against the radiation of heat emanating from the slab. Additional advantages provided by the invention involve a tensioning cylinder connected with the tie rod for mechanically prestressing the rod and also hydraulically unloading or relieving the rod. In addition, a twisting or turning arrangement is provided in engagement with the tie rod. The technical relationship of the tensioning cylinder, the separate turning device, and the tie rod connection enable completely automatic releasing, tensioning, clamping and exchange of the pressing die on the support, without the need for operating personnel to perform manual operations in the replacement of the pressing die in the upsetting press.

Another feature of the exchange or replacement arrangement is that a regulation or actuation piston is connected with tie rod and is arranged in a tension cylinder. One end surface of the piston forms part of a cylinder space in which a hydraulic medium acts while the other end face of the piston bears against a prestressing spring system, preferably a spring washer package. With this arrangement, operating personnel can apply high pressure to the hydraulic medium space of the tension cylinder by an active control signal from a control stand located externally of the upsetting press. Accordingly, the actuating piston can be displaced by an amount, against the force of the spring package, sufficient to displace the hammer head of the tie rod from the abutment surface on the pressing die and to turn the rod, so that the position of the hammer head registers with the opening into the recess. The turning of the hammer head is effected in another advantageous feature of the invention by a turning or rotating device including a rocker or rotary lever fastened to the tie rod. The rocker is connected with a travel controlled displacement arrangement, preferably a piston cylinder unit. As a result, the steps of "loosening the tie rod head from the pressing die" and "turning the tie rod head into alignment with the opening in the recess in the pressing die, that is, turning the head on the abutment surface" can be carried out separately.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
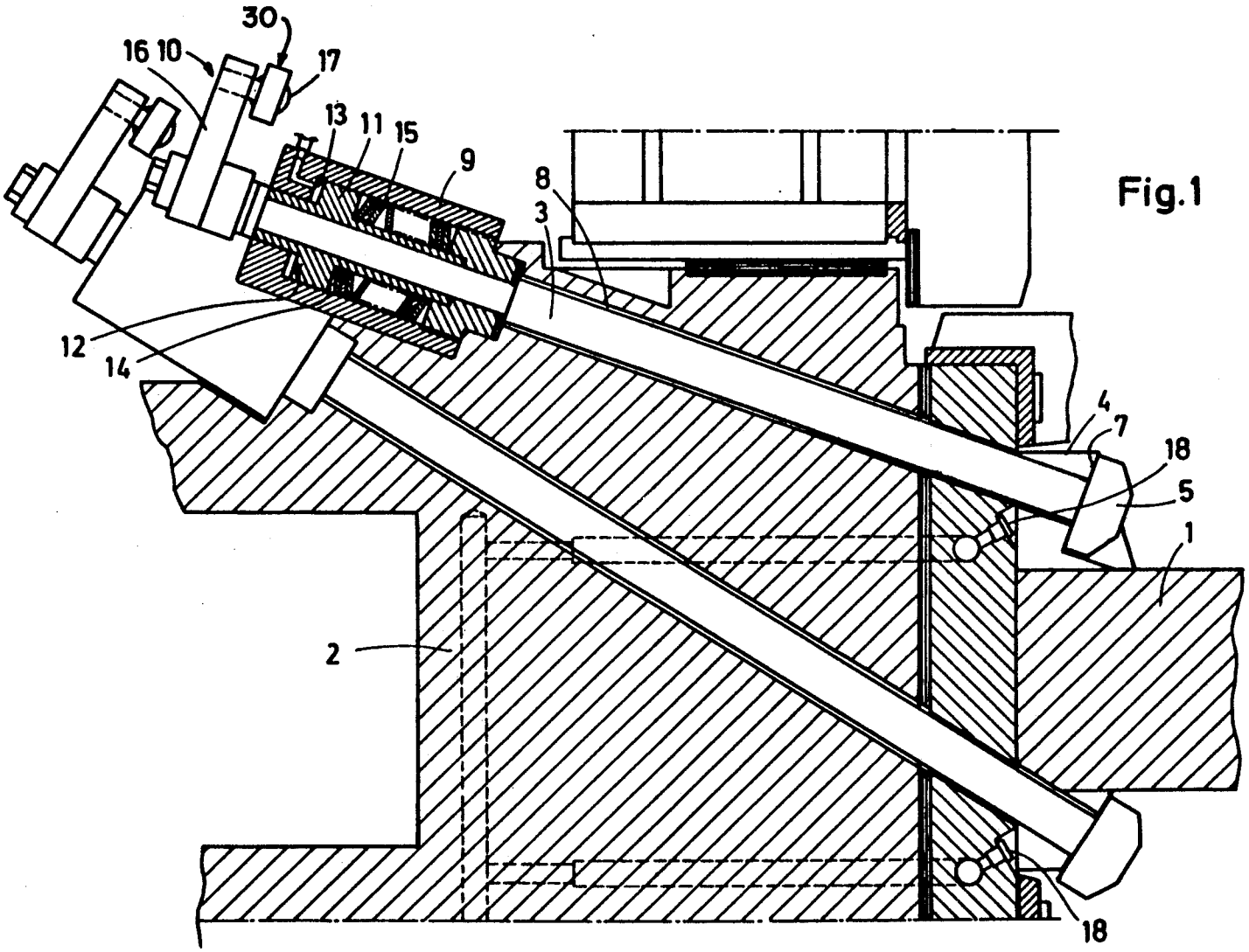
FIG. 1 is a side view, partly in section, of a detachable connection using a tie rod for securing a pressing die on a support.

In FIG. 1 a pressing die 1 is shown detachably connected to a support 2. The pressing face of the die 1 faces the edge of the slab, not shown. The pressing die 1 and the support 2 are part of an upsetting press of the type mentioned above, note shown in detail, for reduction of a slab width, particularly in hot rolled wide band strip mills, where the pressing die 1 and the support 2 are arranged on both sides of the slab. The attachment, detachment and clamping of the pressing die 1 to the support 2 is effected by several tie rods 3 which abut backup flanges 4, 4' on the pressing die extending parallel to one long side of the die. Tie rod head 5 of each tie rod 3 is hammer shaped and engages into a recess 6 in the pressing die shaped to received the tie rod head and support head. The recess 6 is open on one side for receiving the tie rod head. The width of the recess 6 is somewhat greater than the diameter of the tie rod, however, it is clearly smaller than the projecting length of the hammer shaped head 5. In the region of the recess 6, an abutment surface or face 7 is provided on the backup flanges 4, 4' to afford a bearing surface for the corresponding planar surface of the hammer shaped head. The backup flanges 4, 4', containing the recesses 6, are located along the long sides of the pressing die facing the support 2. Tie rods 3 are rotatably positioned in guide bores 8 in the support and are supported therein in spacer bushes, not shown in detail.

In FIG. 1 a tensioning or clamping cylinder 9 is located at the end of the tie rod 3 opposite to the tie rod head 5 and located externally of the support 2. The cylinder 9 is connected with the tie rod and bears against the support 2, so that the tie rod is clamped at both ends, that is, at the pressing die 1 and at the support 2. Tie rod 3 can be hydraulically relieved and mechanically prestressed by the tensioning cylinder 9. The tie rod 3 extends in its axial or long direction through the cylinder 9 and a turning or rotating device 10 is connected to the rod outwardly from the cylinder. A regulating or actuating piston 11 is connected with the tie rod 3 and is located in the cylinder 9 with one surface 12 extending transversely of the tie rod axis forming a part of a cylinder space 13 in which a hydraulic medium acts. A prestressed spring washer package 15 acts on the opposite piston face 14 within the cylinder. The turning device 10 includes a rocker or rotary lever 16 fastened to the tie rod 3 and extending transversely of the rod axis. The rocker or rotary lever 16 is connected to a travel controlled piston cylinder unit 17 which may be of conventional construction and, accordingly, is only shown diagrammatically. The cylinder unit 17 in FIG. 1 stands perpendicularly upon the plane of the paper. The cylinder unit 17 engages lug 30 of the rocker or rotary lever 16 which extends through a slot of said rocker or rotary lever 16 and outward from said rocker or rotary lever 16 as shown in FIG. 1. The lug 30 of the rocker or rotary lever 16 has a termination region having a width larger than the remainder of the lug 30. When activated by the cylinder unit 17, lug 30 of the rocker or rotary lever 16 will move perpendicular to the plane of the paper, thereby causing the rocker or rotary lever 16 to revolve thereby causing the rotation of the tie rod 3 to which said rocker or rotary lever 16 is connected. In the region of the tie rod heads 5 contacting the backup flanges 4, 4', spray nozzles 18 are located for directing a cleaning agent under pressure with the nozzle axes oriented towards the connection of the tie rod heads 5 with the pressing die 1.

Figure 2:
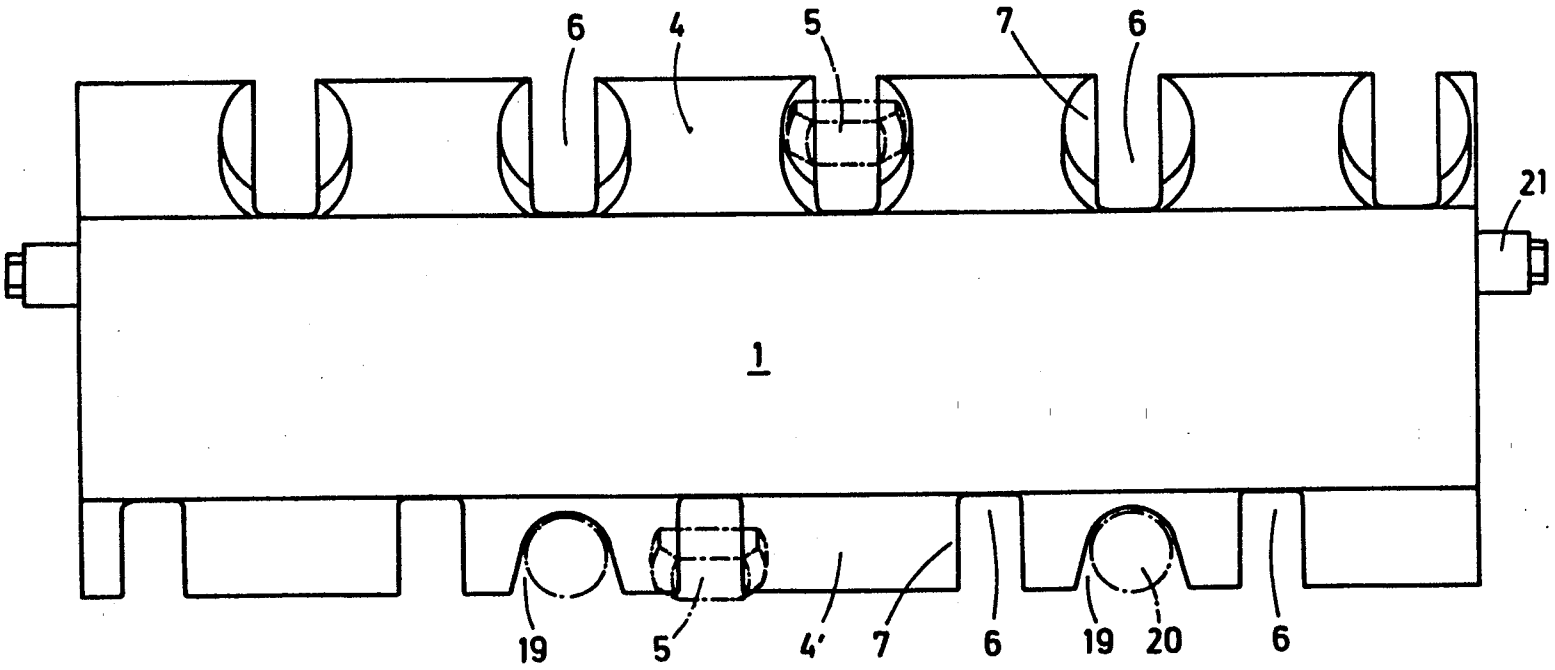
FIG. 2 is a front view of the pressing die with open recesses for receiving tie rod head and with additional adjustment and spotting recesses.

In FIG. 2, the pressing die 1 is shown in front view with recesses 6 in the backup flanges 4, 4' for receiving the tie rod heads. Furthermore, FIG. 2 shows two adjacent or spotting recesses 19 in the flange 4', so that the pressing die 1 can be placed on two spotting or deposit bolts 20 when it is to be detached from the support or to be clamped to it by means of the tie rods 3. On each side of the pressing die extending transversely of the backup flanges 4, 4' there is a suspension bolt 21 on which a replacement device, not shown, engages for lifting the pressing die from the spotting or deposit bolts 19 in the upward direction out of the upsetting press or for installing a new pressing die.

If a new pressing die 1 is to replace the die mounted on the support, because of wear, initially, a cleaning fluid, mostly water, is directed at high pressure by the spray nozzles 18 in the region of the tie rod heads 5, the recesses 6 and the abutment surfaces 7 for removing scale and other adhering contaminating material located in such region. Subsequently, the cylinder space 13 in which the hydraulic medium acts is subjected to a pressure higher than the biasing force of the spring washer package 15 so that the piston 11 moves against the spring washer package and the tie rod head 5 is lifted slightly from the abutment surface 7. In this displaced position, the tie rod and its hammer-shaped tie rod head 5 is turned or rotated about the rod axis by the piston cylinder under 17 acting on the rocker or rotary lever 16 so the elongated direction of the hammer-shaped head register with the direction of the opening in the recess 6. In this position the pressing die is mechanically detached from the support 2 and rests upon the spotting or deposit bolts 20 which engage into the adjacent spotting recesses 19. Subsequently, a tool replacement device, not shown, can grip the pressing die 1 at the side suspension bolts 22 and remove it from the support.

The installation of a new or replacement pressing die takes place in a reverse sequence to the steps just described.

The new pressing die 1 is placed by the replacement device on the spotting or deposit bolts 20 and adjusted relative to the positions of the tie rod heads 5. The tie rod heads 5 are turned or rotated by the turning device so that the back surfaces of the heads face the abutment surfaces 7 of the recesses. Subsequently, pressure from the hydraulic medium in the cylinder space 13 of the tension cylinder 9 is released, whereby the displacement of the piston 11 and with it the tie rod 3 is effected by the spring washer package 15 so that the planar back face of the tie rod head rests or bears against the abutment surface 7 around the recess 6 and is biased by the pressure of the spring washer package against the abutment surface.

The movement of the actuation or displacement piston 11 of the tension cylinder 9 and of the piston cylinder unit 17 are controlled by a hydraulic medium, so that a fully automated detachment and clamping of the pressing die 1 relative to the support 2 is afforded with the further possibility of automated tool replacement carried out from a control stand with the help of an appropriately configured tool replacement arrangement. As a result, the above mentioned task of the invention is carried out in a convincing manner.

While specific embodiments of the invention have been shown and described in detail to illustrate the application of the inventive principles, it will be understood that the invention may be embodied otherwise without departing from such principles.

We claim:

1. An apparatus for detachably connecting a pressing die and a support of an upsetting press, comprising:

a prestressable tie rod having a hammer-shaped tie rod head, wherein said tie rod is held rotatably in guidance bores in said support;

a recess in the pressing die open on one side and essentially adapted to said tie rod head and supporting same, wherein said tie rod engages into said recess; and an abutment surface located on said pressing die and adjoining said recess for supporting said tie rod head and wherein said apparatus further comprises:

a spray nozzle arranged in said support, wherein said spray nozzle is directed toward a region of said tie rod head and said abutment surface of said pressing die for directing a cleaning medium in said region where said tie rod head contacts said abutment surface.

2. An apparatus for detachably connecting a pressing die and a support of an upsetting press, comprising:

a prestressable tie rod having a hammer-shaped tie rod head, wherein said tie rod is held rotatably in guidance bores in said support;

a recess in the pressing die open on one side and essentially adapted to said tie rod head and supporting same, wherein said tie rod engages into said recess; and an abutment surface located on said pressing die and adjoining said recess for supporting said tie rod head, and wherein said apparatus further comprises:

a clamping cylinder connected to said tie rod and which is located on a side of said support opposite from said pressing die for one of mechanically prestressing and hydraulically releasing said tie rod and further comprising:

a turning device located adjacent said clamping cylinder and in engagement with said tie rod for rotating said tie rod about an elongated direction thereof.

3. The apparatus of claim 2, further comprising:

a piston located in said clamping cylinder and connected with said tie rod wherein said piston comprises:

a first piston surface extending transversely of said elongated direction of said tie rod and forming part of a cylinder space acted upon by a hydraulic medium, and a second piston surface on an opposite side of said piston from said first piston surface; and a spring washer package located within said cylinder wherein said spring washer package supplies a biasing force on said second piston surface so as to maintain said tie rod head in contact with said abutment surface.

4. The apparatus of claim 3 wherein said turning device further comprises:

one of a rocker and a rotary lever fastened to said tie rod and having a lug portion extending transversely therefrom relative to an elongated axis of said tie rod; and a piston cylinder unit in contact with said lug portion of one of said rocker and said rotary lever spaced outwardly from said tie rod for effecting a displacement of one of said rocker and said rotary lever and a rotation of said tie rod about said elongated axis thereof.

5. An apparatus for detachably connecting a pressing die and a support of an upsetting press, comprising:

a prestressable tie rod having a hammer-shaped tie rod head, wherein said tie rod is held rotatably in guidance bores in said support;

a recess in said pressing die open on one side and essentially adapted to said tie rod head and supporting same, wherein said tie rod engages into said recess;

an abutment surface located on said pressing die and adjoining said recess for supporting said tie rod head;

at least one abutment flange on said pressing die, wherein said abutment surface is arranged on said abutment flange, and further wherein said abutment flange extends on longitudinal sides of said pressing die and further wherein said abutment flange is located on a side of said pressing die which faces said support; and at least one bolt which is connected to said support;

wherein at least one of said abutment flange includes at least one additional adjustment offset recess, wherein said abutment flange engages said bolt.

6. An apparatus for detachably connecting a pressing die to a support of an upsetting press, comprising:

an elongated prestressable tie rod rotatably mounted on said support wherein said tie rod further comprises a hammer-shaped tie rod head;

a recess in said pressing die wherein said tie rod head is engageable in said recess and wherein said recess receives said tie rod;

an abutment surface located on said pressing die and adjoining said recess for supporting said tie rod head; and a spray nozzle arranged in said support and which is directed toward said tie rod head and an abutment flange of said pressing die for directing a cleaning medium in a region where said the rod head contacts said abutment flange.

7. An apparatus for detachably connecting a pressing die to a support of an upsetting press, comprising:

at least one elongated prestressable tie rod rotatably mounted on said support wherein said tie rod further comprises a hammer-shaped tie rod head;

at least one recess in said pressing die wherein said tie rod head is engageable in said at least one recess and wherein said at least one recess receives said tie rod;

an abutment surface located on said pressing die and adjoining said recess for supporting said tie rod head;

at least one abutment flange on said pressing die which extends on longitudinal sides of said pressing die and is located on a side of said pressing die which faces said support, wherein said abutment flange has said at least one recess therein and further wherein said abutment surface is located on said at least one abutment flange and is adjacent to said recess; and a spray nozzle arranged in said support and which is directed toward said tie rod head and said abutment surface of said pressing die for directing a cleaning medium in a region where said tie rod head contacts said abutment surface.

8. An apparatus for detachably connecting a pressing die to a support of an upsetting press, comprising:

an elongated prestressable tie rod rotatably mounted on said support wherein said tie rod further comprises a hammer-shaped tie rod head;

a recess in said pressing die wherein said tie rod head is engageable in said recess and wherein said recess receives said tie rod;

an abutment surface located on said pressing die and adjoining said recess for supporting said tie rod head;

a guide bore extending through said support in a direction opposite said pressing die wherein said guide bore supports said tie rod;

a clamping cylinder connected to said tie rod and which is located on the side of said support opposite said pressing die for one of mechanically prestressing and hydraulically releasing said tie rod; and a turning device located adjacent said clamping cylinder and in engagement with said tie rod for rotating said tie rod about an elongated direction thereof.

9. The apparatus of claim 8 further comprising:

a piston located in said clamping cylinder and connected with said tie rod, said piston having a first piston surface extending transversely of an elongated direction of said tie rod and forming part of a cylinder space wherein said cylinder space is acted upon by a hydraulic medium and a second piston surface located on a side of said piston opposite said first piston surface; and a spring washer package within said cylinder which acts on said second piston surface and which supplies a biasing force so as to maintain said tie rod head in contact with said abutment surface.

10. The apparatus of claim 9 wherein said turning device comprises one of a rocker and a rotary lever connected with said tie rod and extending transversely therefrom relative to an elongated axis of said tie rod, and further wherein said apparatus further comprises:

a piston cylinder unit connected to one of said rocker and said rotary lever for effecting a displacement of one of said rocker and said rotary lever and for effecting a rotation of said tie rod about said elongated axis thereof.

11. An apparatus for detachably connecting a pressing die to a support of an upsetting press, comprising:

an elongated prestressable tie rod rotatably mounted on said support wherein said tie rod further comprises a hammer-shaped tie rod head;

at least one recess in said pressing die wherein said tie rod head is engageable in said at least one recess and wherein said at least one recess receives said tie rod;

an abutment surface located on said pressing die and adjoining said recess for supporting said tie rod head;

at least one abutment flange on said pressing die which extends on longitudinal sides of said pressing die and is located on a side of said pressing die which faces said support, wherein said abutment flange has said at least one recess therein and further wherein said abutment surface is located on said at least one abutment flange and is adjacent to said at least one recess;

a guide bore extending through said support in a direction opposite said pressing die wherein said guide bore supports said tie rod; and a clamping cylinder connected to said tie rod and which is located on a side of said support opposite said pressing die for one of mechanically prestressing and hydraulically releasing said tie rod; and a turning device located adjacent said clamping cylinder and in engagement with said tie rod for rotating said tie rod about an elongated direction thereof.

12. The apparatus of claim 11 further comprising:

a piston located in said clamping cylinder and connected with said tie rod, said piston having a first piston surface extending transversely of an elongated direction of said tie rod and forming part of a cylinder space wherein said cylinder space is acted upon by a hydraulic medium and a second piston surface located on a side of said piston opposite said first piston surface; and a spring washer package within said cylinder which acts on said second piston surface and which supplies a biasing force so as to maintain said tie rod head in contact with said abutment surface.

13. The apparatus of claim 12 wherein said turning device comprises one of a rocker and a rotary lever connected with said tie rod and extending transversely therefrom relative to an elongated axis of said tie rod, and wherein said apparatus further comprises:

a piston cylinder unit connected to one of said rocker and said rotary lever for effecting a displacement of one of said rocker and said rotary lever and for effecting a rotation of said tie rod about said elongated axis thereof.

14. An apparatus for detachably connecting a pressing die and a support of an upsetting press, comprising:

a prestressable tie rod having a hammer-shaped tie rod head, wherein said tie rod is held rotatably in guidance bores in said support;

a recess in said pressing die open on one side and essentially adapted to said tie rod head and supporting same, wherein said tie rod engages into said recess;

an abutment surface located on said pressing die and adjoining said recess for supporting said tie rod head;

at least one abutment flange on said pressing die, wherein said abutment surface is arranged on said abutment flange, and further wherein said abutment flange extends on longitudinal sides of said pressing die and further wherein said abutment flange is located on a side of said pressing die which faces said support; and at least one bolt which is connected to said support;

wherein at least one of said abutment flange includes at least one additional adjustment offset recess, wherein said abutment flange engages said bolt, and wherein said apparatus further comprises:

a spray nozzle arranged in said support, wherein said spray nozzle is directed toward a region of said tie rod head and said abutment surface of said pressing die for directing a cleaning medium in said region where said tie rod head contacts said abutment surface.

15. An apparatus for detachably connecting a pressing die and a support of an upsetting press, comprising:

a prestressable tie rod having a hammer-shaped tie rod head, wherein said tie rod is held rotatably in guidance bores in said support;

a recess in said pressing die open on one side and essentially adapted to said tie rod head and supporting same, wherein said tie rod engages into said recess;

an abutment surface located on said pressing die and adjoining said recess for supporting said tie rod head;

at least one abutment flange on said pressing die, wherein said abutment surface is arranged on said abutment flange, and further wherein said abutment flange extends on longitudinal sides of said pressing die and further wherein said abutment flange is located on a side of said pressing die which faces said support; and at least one bolt which is connected to said support;

wherein at least one of said abutment flange includes at least one additional adjustment offset recess, wherein said abutment flange engages said bolt, and wherein said apparatus further comprises:

a clamping cylinder connected to said tie rod and which is located on a side of said support opposite from said pressing die for one of mechanically prestressing and hydraulically releasing said tie rod and further comprising:

a turning device located adjacent said clamping cylinder and in engagement with said tie rod for rotating said tie rod about an elongated direction thereof.

16. The apparatus of claim 15, further comprising:

a piston located in said clamping cylinder and connected with said tie rod wherein said piston comprises:

a first piston surface extending transversely of said elongated direction of said tie rod and forming part of a cylinder space acted upon by a hydraulic medium;

and a second piston surface on an opposite side of said piston from said first piston surface; and a spring washer package located within cylinder wherein said spring washer package supplies a biasing force on said second piston surface so as to maintain said tie rod head in contact with said abutment surface.

17. The apparatus of claim 16 wherein said turning device further comprises:

one of a rocker and rotary lever fastened to said tie rod and having a lug portion extending transversely therefrom relative to an elongated axis of said tie rod; and a piston cylinder unit in contact with said lug portion of one of said rocker and said rotary lever spaced outwardly from said tie rod for effecting a displacement of one of said rocker and said rotary lever and a rotation of said tie rod about said elongated axis thereof.

* * * * *